US011730240B2

(12) United States Patent
Yamashita

(10) Patent No.: US 11,730,240 B2
(45) Date of Patent: Aug. 22, 2023

(54) BUCKLE AND TIMEPIECE

(71) Applicant: SEIKO EPSON CORPORATION, Tokyo (JP)

(72) Inventor: Yuki Yamashita, Shiojiri (JP)

(73) Assignee: SEIKO EPSON CORPORATION

( * ) Notice: Subject to any disclaimer, the term of this patent is extended or adjusted under 35 U.S.C. 154(b) by 0 days.

(21) Appl. No.: 17/854,719

(22) Filed: Jun. 30, 2022

(65) Prior Publication Data

US 2023/0000220 A1 Jan. 5, 2023

(30) Foreign Application Priority Data

Jul. 1, 2021 (JP) ..... 2021-110107

(51) Int. Cl.
*A44C 5/20* (2006.01)
*A44B 11/20* (2006.01)
*A44C 5/24* (2006.01)

(52) U.S. Cl.
CPC ..... *A44C 5/2066* (2013.01); *A44B 11/20* (2013.01); *A44C 5/246* (2013.01)

(58) Field of Classification Search
CPC ..... A44C 5/246; A44C 5/24; A44C 5/2066; A44B 11/20
See application file for complete search history.

(56) References Cited

U.S. PATENT DOCUMENTS 2,455,302 A * 11/1948 Gotti ..... A44C 5/246 24/71 J
2,500,649 A * 3/1950 Szeglin ..... A44C 5/246 24/71 J
2,596,186 A * 5/1952 Volk ..... A44C 5/246 24/71 J
6,944,916 B2 * 9/2005 Kawagoe ..... A44C 5/246 24/70 J
9,149,093 B2 * 10/2015 Leger ..... A44C 5/246
2014/0223705 A1 8/2014 Catanese

FOREIGN PATENT DOCUMENTS

JP 2015-164567 A 9/2015

* cited by examiner

*Primary Examiner* — Robert Sandy
(74) *Attorney, Agent, or Firm* — Harness, Dickey & Pierce, P.L.C.

(57) ABSTRACT

A buckle includes a folding member, a buckle cover pivotably linked to the folding member, a slide plate supported slidably relative to the buckle cover in the longitudinal direction of the band, and a swing arm rotatably supported by the buckle cover. The slide plate has a plurality of groove sections provided along the longitudinal direction. The swing arm includes a base, an arm section, an engagement click, and an operation strip, and is supported rotatably in a first rotational direction in which the engagement click engages with any of the groove sections and in a second rotational direction in which the engagement click separates from the groove section. The folding member includes a protruding section that comes into contact with the operation strip to rotate the swing arm in the second rotational direction when the folding member is rotated relative to the buckle cover.

8 Claims, 11 Drawing Sheets

BUCKLE AND TIMEPIECE

The present application is based on, and claims priority from JP Application Serial Number 2021-110107, filed Jul. 1, 2021, the disclosure of which is hereby incorporated by reference herein in its entirety.

BACKGROUND

1. Technical Field

The present disclosure relates to a buckle used in a band such as a timepiece band and a band for an ornamental accessory, and a timepiece including the buckle.

2. Related Art

Some related-art buckles used in wristwatch bands include a device that allows fine adjustment of the length of the band (see JP-A-2015-164567, for example).

The buckle described in JP-A-2015-164567 includes a push button that is located at the rear surface of a buckle cover and releases a locking mechanism of a band length adjustment mechanism. When the push button is pressed, an end link coupled to a bracelet becomes movable relative to the buckle cover so that the length of the bracelet can be adjusted.

The buckle described in JP-A-2015-164567 requires operation of the push button at the rear surface of the buckle cover to adjust the band length, and the button operation is cumbersome. Furthermore, the buckle is formed of a large number of parts, resulting in another problem of an increase in cost.

SUMMARY

A buckle according to an aspect of the present disclosure is a buckle that links a first band and a second band to each other, the buckle including a folding member linked to the first band, a buckle cover pivotably linked to the folding member, a slide plate supported slidably relative to the buckle cover in a longitudinal direction of the first band and the second band and linked to the second band, and a swing arm rotatably supported by the buckle cover. The slide plate has a plurality of groove sections provided along the longitudinal direction. The swing arm includes a base rotatably supported by the buckle cover, an arm section extending from the base toward the slide plate, an engagement click provided at the arm section and engageable with any of the groove sections of the slide plate, and an operation strip extending from the base toward a side opposite to the arm section, the swing arm supported rotatably in a first rotational direction in which the engagement click engages with any of the groove sections and in a second rotational direction in which the engagement click separates from the groove section. The folding member includes a protruding section that comes into contact with the operation strip to rotate the swing arm in the second rotational direction when the folding member is rotated relative to the buckle cover.

A timepiece according to another aspect of the present disclosure includes the buckle described above.

DESCRIPTION OF EXEMPLARY EMBODIMENTS

An embodiment of the present disclosure will be described below with reference to the drawings.

Figure 1:
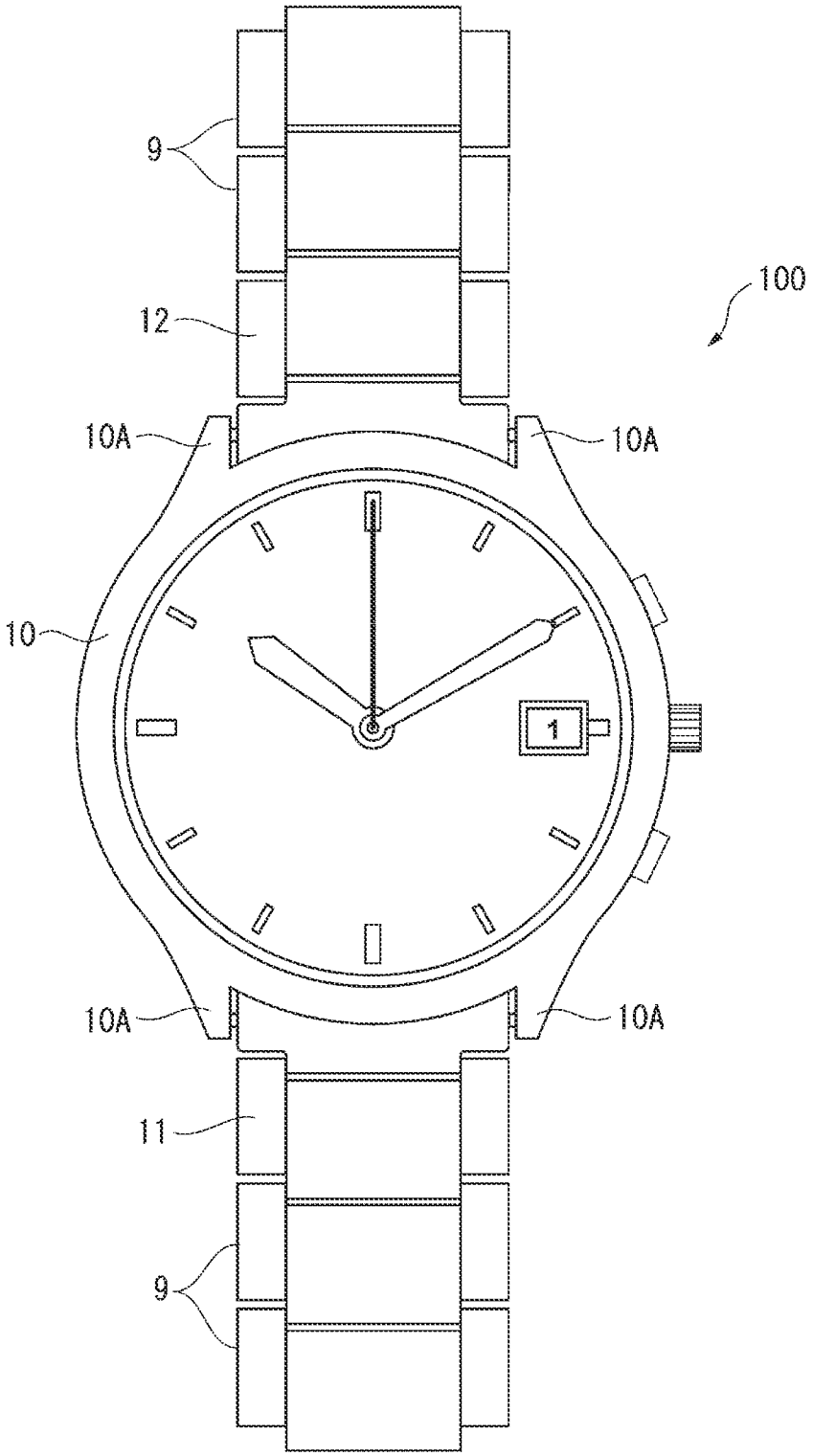
FIG. 1 is a front view showing a wristwatch according to an embodiment.

A wristwatch 100 as a timepiece includes an exterior case 10, a first band 11, and a second band 12, as shown in FIG. 1. Lugs 10A are provided as parts integrated with the exterior case 10 at 6-o'clock and 12-o'clock sides thereof. The first band 11 is linked to the 6-o'clock-side lugs 10A with an attaching pin, and the second band 12 is linked to the 12-o'clock-side lugs 10A with another attaching pin.

The first band 11 and the second band 12 are each formed of a plurality of band pieces 9 linked to each other with pins that are not shown.

The free ends of the first band 11 and the second band 12 are fastened to each other via a buckle 1 shown in FIGS. 2 to 5.

Figure 2:
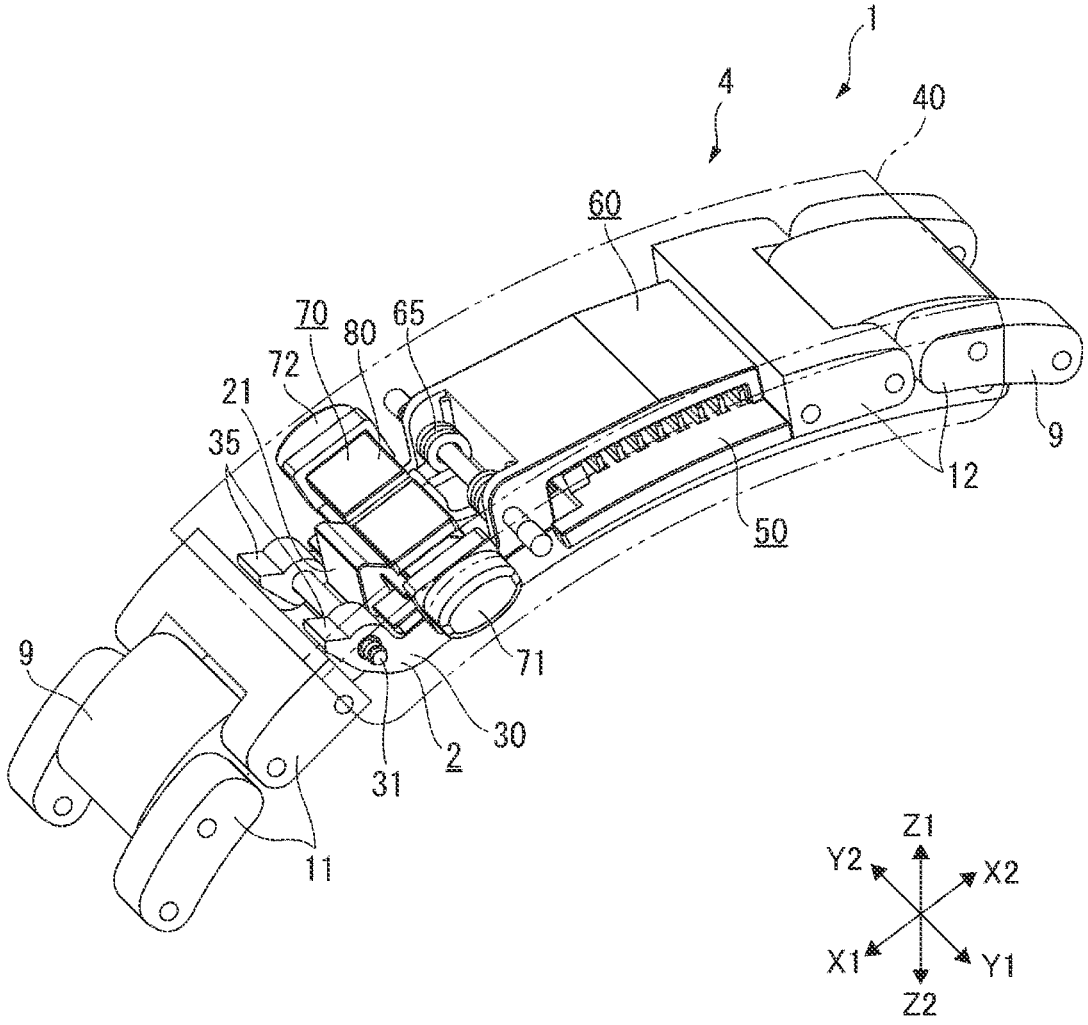
FIG. 2 is a perspective view showing a buckle with a folding member according to the embodiment folded.
Figure 3:
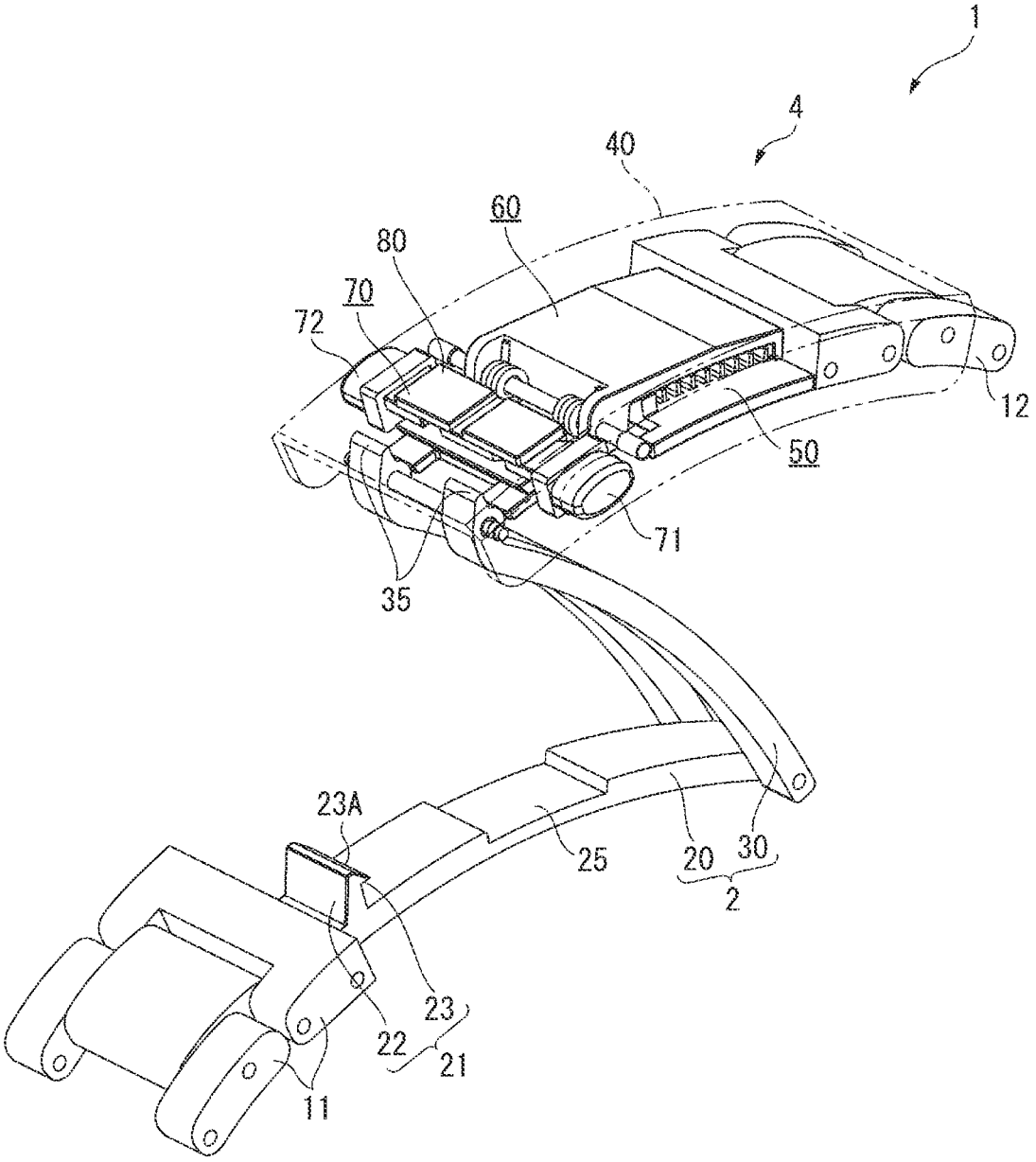
FIG. 3 is a perspective view showing the buckle with the folding member according to the embodiment unfolded.
Figure 4:
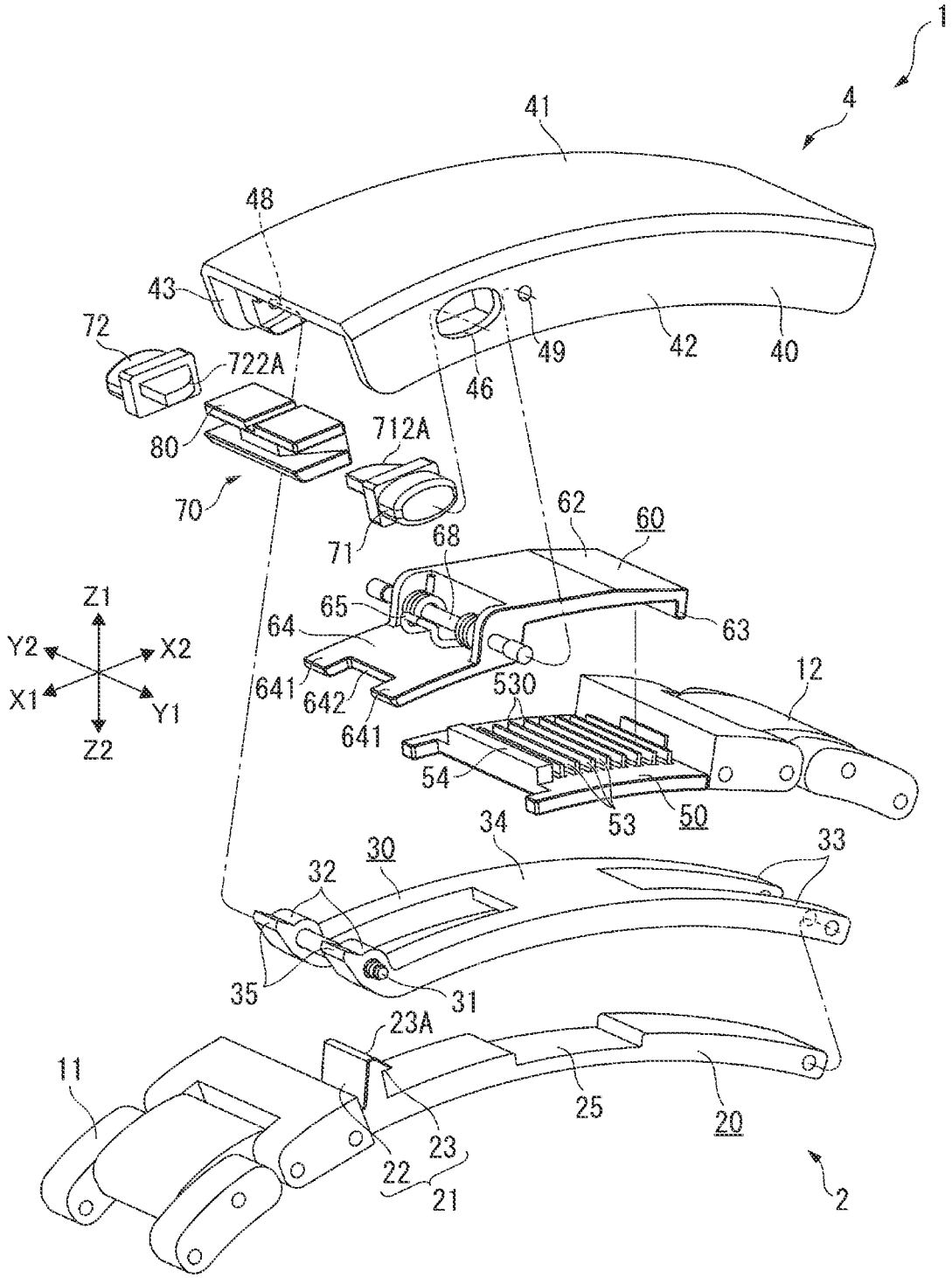
FIG. 4 is an exploded perspective view of the buckle according to the embodiment.
Figure 5:
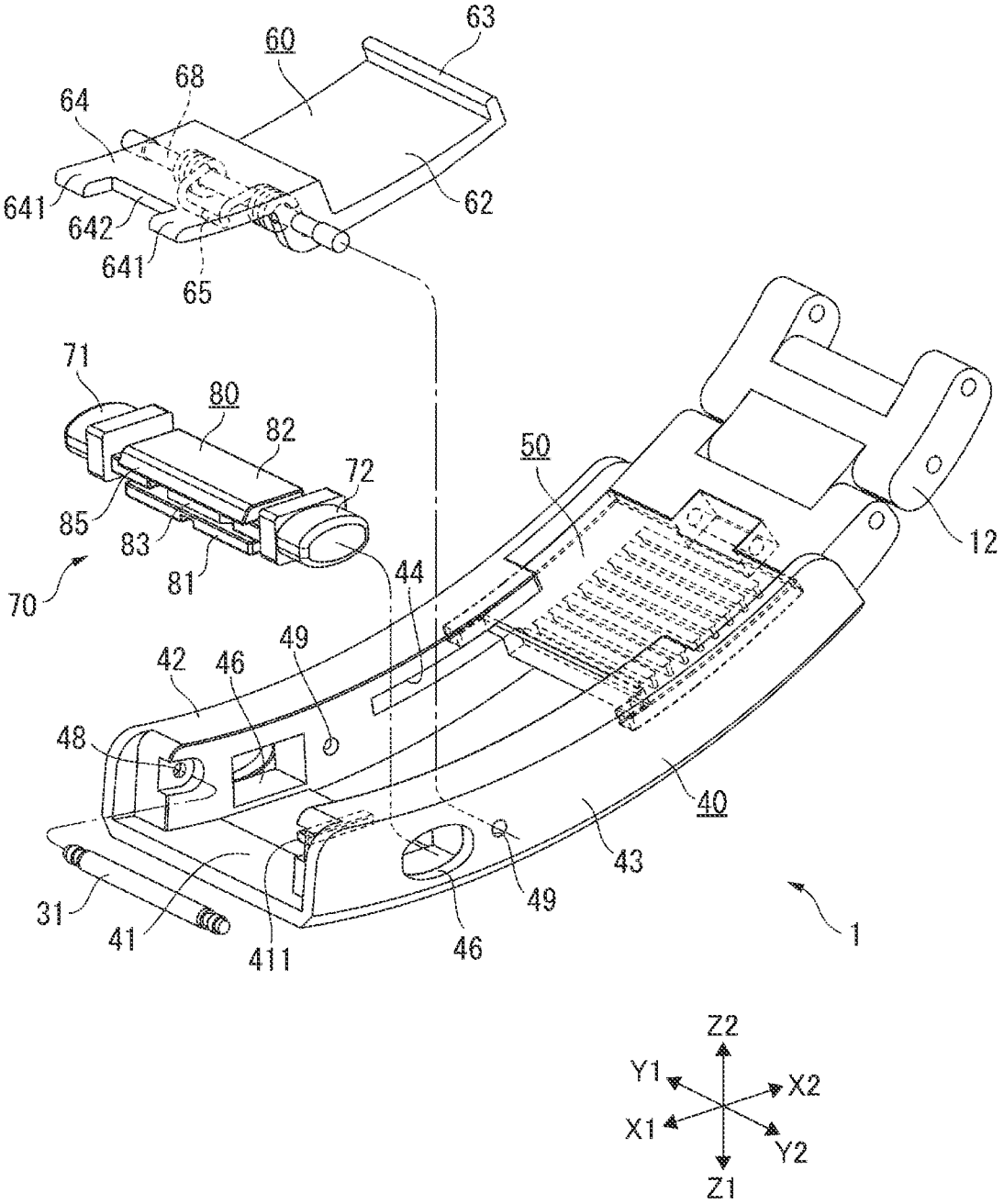
FIG. 5 is a partially exploded perspective view showing the rear side of a buckle cover according to the embodiment.

The buckle 1 is a three-fold buckle including a folding member 2. FIG. 2 is a perspective view of the buckle 1 with the folding member 2 folded and accommodated in the buckle 1. FIG. 3 is a perspective view of the buckle 1 with the folding member 2 unfolded. FIG. 4 is an exploded perspective view of the buckle 1. FIG. 5 is a partially exploded perspective view showing the rear side of a buckle cover 40.

Figure 6:
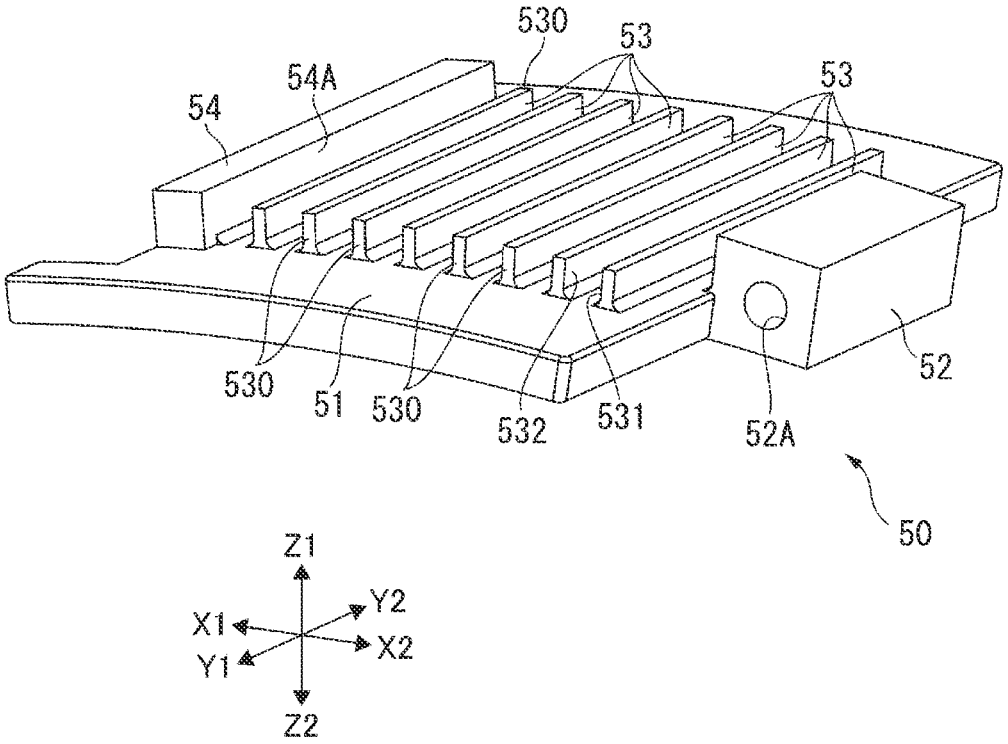
FIG. 6 is a perspective view showing a slide plate according to the embodiment.
Figure 7:
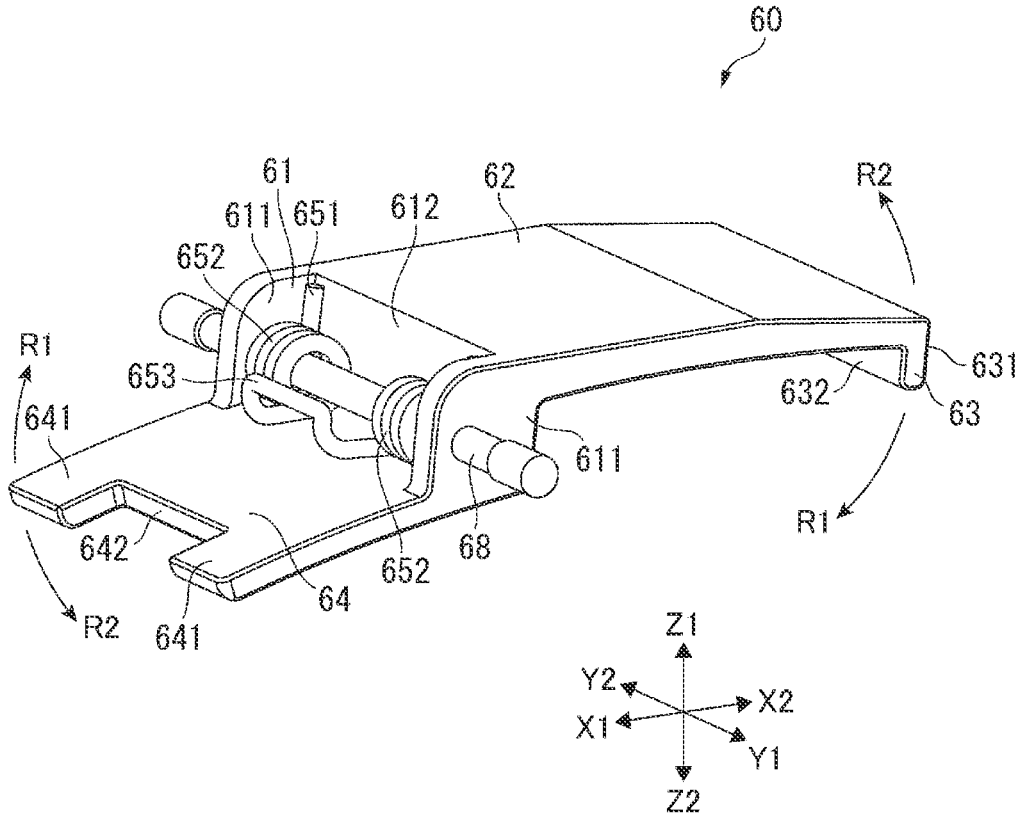
FIG. 7 is a perspective view showing a swing arm according to the embodiment.
Figure 8:
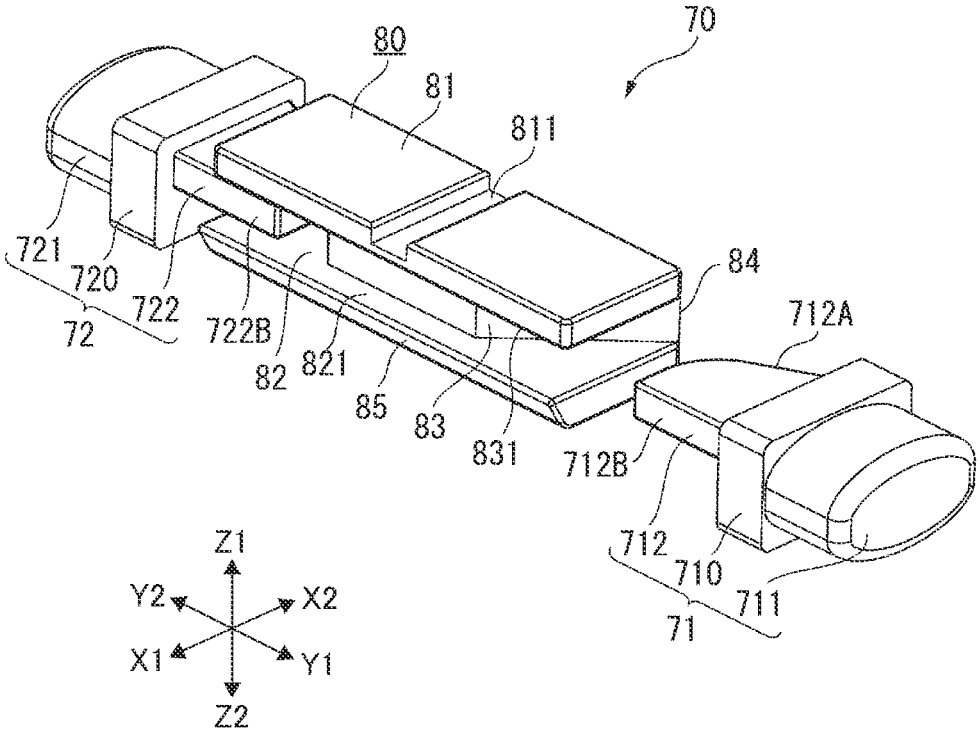
FIG. 8 is a partially exploded perspective view showing a button unit according to the embodiment.
Figure 9:
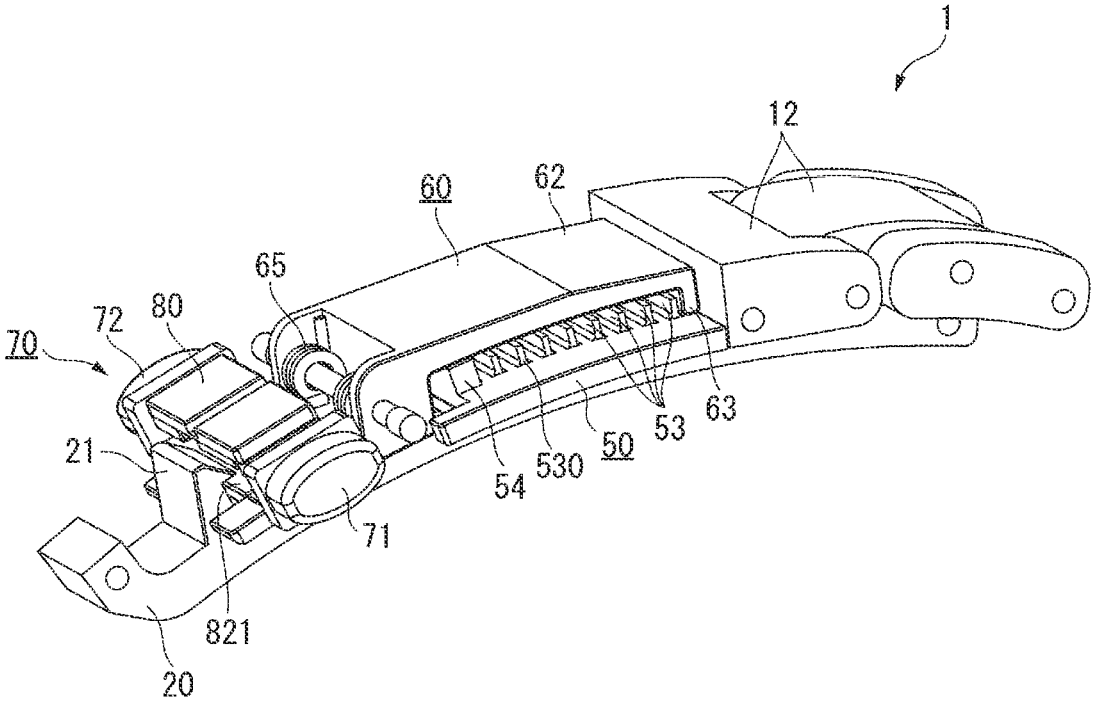
FIG. 9 is a perspective view showing key parts of the locked buckle in the embodiment.
Figure 10:
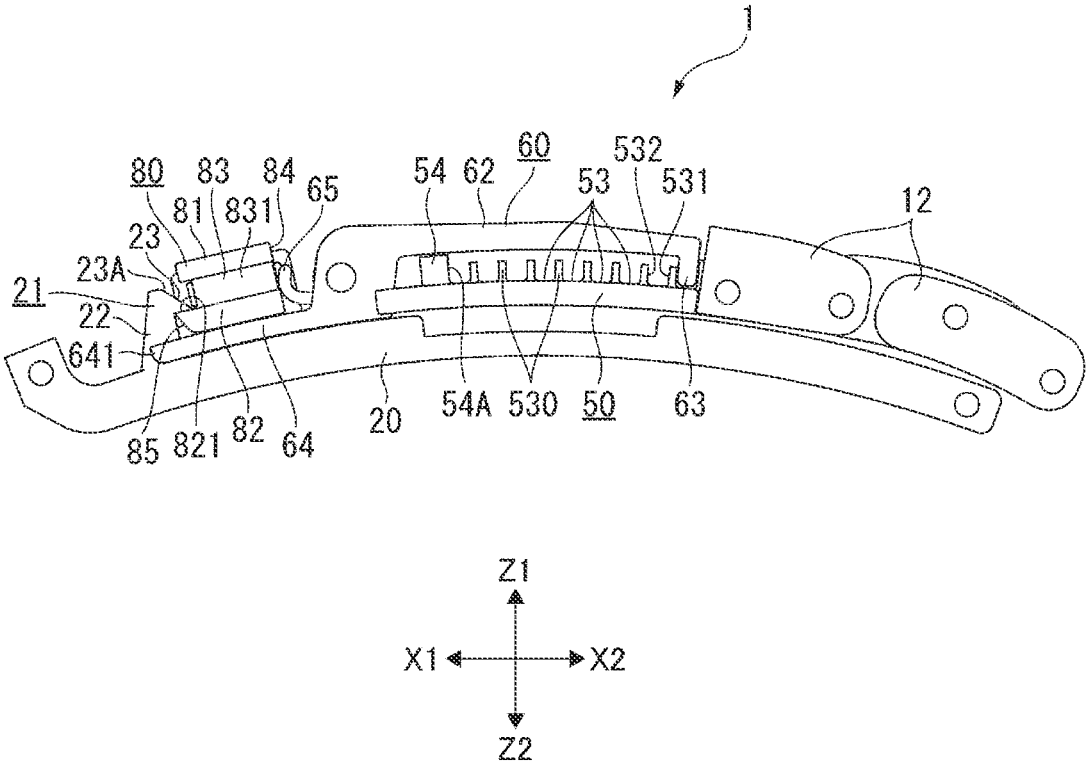
FIG. 10 is a side view showing the key parts of the locked buckle in the embodiment.

FIG. 6 is a perspective view of a slide plate 50. FIG. 7 is a perspective view of a swing arm 60. FIG. 8 is a perspective view of a button unit 70. FIG. 9 is a perspective view showing key parts of the locked buckle 1. FIG. 10 is a side view showing the key parts of the locked buckle 1.

It is assumed in each of the figures that an axis X is an axis extending along the longitudinal direction of the first band 11 and second band 12, that an axis Y is an axis perpendicular to the axis X and extending along the width direction of the first band 11 and the second band 12, and that an axis Z is an axis perpendicular to the axes X and Y. The directions of the axis X are defined as follows: a direction X1 is the direction from the buckle 1 toward the first band 11; and a direction X2 is the direction from the buckle 1 toward the second band 12. The directions of the axis Y are defined as follows: a direction Y1 is the direction from the center of the buckle cover 40 in the width direction toward a first sidewall section 42; and a direction Y2 is the direction from the center toward a second sidewall section 43. The directions of the axis Z are defined as follows: a direction Z1 is the direction from the folding member 2 toward the buckle cover 40, that is, toward the front surface of the buckle 1; and a direction Z2 is the direction from the buckle cover 40 toward the folding member 2, that is, toward the rear surface of the buckle 1. In each part of the buckle 1, a surface facing the direction Z1 is called as a front surface, and a surface facing the direction Z2 is called a rear surface in some cases.

The buckle 1 includes the folding member 2 and a buckle body 4, as shown in FIGS. 2 to 4.

The folding member 2 includes a middle plate 20 and an outer plate 30.

The middle plate 20 is a member elongated along the axis-X direction, which is the longitudinal direction of the first band 11, and the end of the middle plate 20 in the direction X1 is pivotably linked to the first band 11, as shown in FIGS. 3 and 4. The end of the middle plate 20 in the direction X2 is pivotably linked to one end of the outer plate 30.

The middle plate 20 is provided with a hook 21. The hook 21 is provided at the front surface of the middle plate 20 in the vicinity of an end of the middle plate 20, the end linked to the first band 11. The hook 21 includes a protruding section 22, which protrudes in the direction Z1, and a click section 23, which protrudes in the direction X2 from the protruding section 22. The front surface of the click section 23 is an inclining surface 23A, which inclines in the direction Z2, that is, downward as extending in the direction X2, as shown in FIGS. 3 and 10. A stepped section 25 having a recessed surface is formed in an intermediate portion of the middle plate 20 in the longitudinal direction.

The end of the outer plate 30 in the direction X1 is pivotably linked to the buckle cover 40 with a spring rod 31. The outer plate 30 includes shafts 32, through which the spring rod 31 is inserted, bodies 33, which extend from the shafts 32 along the axis-X direction, which is the longitudinal direction of the bands, and disposed on the right and left sides of the middle plate 20, and a linker 34, which links the bodies 33 to each other and has a convex rear surface placed at the stepped section 25 of the middle plate 20, as shown in FIG. 4.

The hook 21 of the middle plate 20 is therefore provided so as to protrude in the direction Z1 through one opening between the bodies 33 of the outer plate 30 when the folding member 2 is folded. Portions of the middle plate 20 other than the stepped section 25 thereof are located in the openings between the bodies 33 of the outer plate 30, and the front surfaces of the middle plate 20 and the outer plate 30 are configured to be located substantially in the same plane, and so are the rear surfaces thereof.

Furthermore, protruding sections 35, which cause rotation of the swing arm 60, which will be described later, are formed at the shafts 32.

Configuration of Buckle Body

The buckle body 4 includes the buckle cover 40, the slide plate 50, the swing arm 60, and the button unit 70, as shown in FIGS. 2 to 4.

The buckle cover 40 has a plate-shaped front surface section 41, which is arcuately curved along the directions X1 and X2, which are the directions in which the slide plate 50 slides, and the first sidewall section 42 and the second sidewall section 43, which protrude from the outer edges of the front surface section 41 in the directions Y1 and Y2 toward the rear side of the buckle cover 40, as shown in FIGS. 4 and 5.

A guide rail section 411, which continuously extends in the axis-X direction, is formed at the rear surface of the front surface section 41.

Guide grooves 44, which guide the slide plate 50 in a slidable manner, and through holes 46, through which a first button 71 and a second button 72 of the button unit 70 are inserted, are formed at the first sidewall section 42 and the second sidewall section 43. The outer-surface-side opening of each of the through holes 46 has an elliptical shape, and the inner-surface-side opening of the through hole 46 has a rectangular shape and is larger than the outer elliptical opening; the two openings are formed in accordance with the shapes of the first button 71 and the second button 72.

Furthermore, the first sidewall section 42 and the second sidewall section 43 each have a hole 48, to which the spring rod 31, to which the outer plate 30 is linked, is attached, and a through hole 49, through which a pin 68, which serves as a shaft to which the swing arm 60 is rotatably attached, is inserted.

The slide plate 50 is disposed between the buckle cover 40 and the folding member 2 and provided so as to be slidable along the guide grooves 44 of the buckle cover 40 in the directions X1 and X2, which are the longitudinal direction of the first band 11 and second band 12, as shown in FIGS. 2 to 4.

The slide plate 50 includes a plate section 51, which has right and left ends disposed in the guide grooves 44 described above, a linkage section 52 formed at an end of the plate section 51, and groove sections 53 and a movement restriction section 54, which are formed at the front surface of the plate section 51, as shown in FIG. 6. The slide plate 50 has a front end that is the end which faces the direction X1 and where the movement restriction section 54 is formed, and a rear end that is the end which faces the direction X2 and where the linkage section 52 is formed. A through hole 52A is formed in the linkage section 52, and a linkage pin to which the second band 12 is linked is inserted through the through hole 52A.

A plurality of plate-shaped groove wall sections 530 are formed at intervals in the axis-X direction at the front surface of the plate section 51 of the slide plate 50, and the groove wall sections 530 stand upright in a direction substantially perpendicular to the axis-X direction, which is the direction in which the slide plate 50 moves. The groove wall sections 530 each have a first perpendicular surface 531 and a second perpendicular surface 532, which are substantially perpendicular to the plate section 51 and form each of the groove sections 53, which each have a substantially rectangular shape in a side view. The first perpendicular surface 531 is a surface of the groove wall section 530, the surface facing the movement restriction section 54, that is, the direction X1, and the second perpendicular surface 532 is a surface of the groove wall section 530, the surface facing the linkage section 52, that is, the direction X2. Groove sections 53 are also formed between the groove wall section 530 on the side farthest in the direction X1 and the movement restriction section 54, and between the groove wall section 530 on the side farthest in the direction X2 and the linkage section 52. The slide plate 50 shown in FIG. 6 has eight groove wall sections 530 formed therein, seven groove sections 53 formed between the groove wall sections 530, and two groove sections 53 formed between the groove wall sections and the movement restriction section 54 and the linkage section 52, a total of nine groove sections 53.

The movement restriction section 54 is a protruding section having a substantially rectangular cross section and continuously extending in the width direction of the slide plate 50, as the groove wall sections 530 are. The movement restriction section 54 is provided so as to face the first perpendicular surface 531 of the groove wall section 530 on the side farthest in the direction X1 and protrudes beyond the upper end of the groove wall section 530, that is, toward the front surface section 41. A side surface of the movement restriction section 54, the surface facing the groove wall section 530, is a restriction surface 54A perpendicular to the direction in which the slide plate 50 moves.

The swing arm 60 is disposed between the front surface section 41 of the buckle cover 40 and the slide plate 50 and pivotably attached to the buckle cover 40 via the pin 68, which has the shape of a round rod and is inserted through and fixed in the through holes 49 in the first sidewall section 42 and the second sidewall section 43, as shown in FIGS. 2 to 4. As the structure that fixes the pin 68 to the first sidewall section 42 and the second sidewall section 43, a ring-shaped fixing member or any other component may be press-fit into and fixed in the gap between the pin 68 and each of the through holes 49, or the pin 68 may be screwed into the through holes 49, that is, the pin 68, which serves as the axis of rotation, only needs to be fixed so as not to come off the through holes 49.

The swing arm 60 includes a base 61, which is rotatably supported by the pin 68, an arm section 62, which extends from the base 61 in the direction X2, that is, toward the slide plate 50 and has an engagement click 63, and an operation strip 64, which extends from the base 61 in the direction X1, as shown in FIG. 7.

The base 61 includes a pair of support walls 611, through which the pin 68 is inserted, and a linkage wall 612, which links the support walls 611 to each other. A torsional spring 65 is disposed between the support walls 611. The torsional spring 65 includes first contact sections 651, which are disposed inside the support walls 611 and are in contact with an upper end portion of the linkage wall 612, coil sections 652, through which the pin is inserted, and a second contact section 653, which protrudes toward the button unit 70.

The arm section 62 extends in the direction X2 from an upper portion of the base 61, that is, the side facing the front surface section 41 of the buckle cover 40. The arm section 62 is therefore disposed along the front surface section 41.

The engagement click 63 has a first facing surface 631 and a second facing surface 632 so provided as to extend from the front end of the arm section 62 along the direction Z2, which is substantially perpendicular to the direction X2, which is the direction in which the arm section 62 extends. The engagement click 63 is formed in a substantially rectangular shape in a side view and is configured to be engageable with any of the groove sections 53 between the groove wall sections 530 of the slide plate 50. The first facing surface 631 is an outer surface facing the linkage section 52 of the slide plate 50 and faces the first perpendicular surface 531 when the engagement click 63 engages with the groove section 53. The second facing surface 632 is an inner surface facing the movement restriction section 54 of the slide plate 50 and faces the second perpendicular surface 532 when the engagement click 63 engages with the groove section 53.

The operation strip 64 extends in the direction X1 from a lower portion of the base 61, that is, from the side facing the folding member 2. The arm section 62 and the operation strip 64 are therefore disposed so as to sandwich the pin 68, which serves as the axis of rotation of the swing arm 60. Therefore, when the arm section 62 rotates in a first rotational direction R1, in which the arm section 62 approaches the slide plate 50, the operation strip 64 rotates in the first rotational direction R1, in which the operation strip 64 moves away from the folding member 2. When the arm section 62 rotates in a second rotational direction R2, in which the arm section 62 moves away from the slide plate 50, the operation strip 64 rotates in the second rotational direction R2, in which the operation strip 64 approaches the folding member 2.

A pair of protrusions 641 extend in the direction X1 from opposite ends of the operation strip 64 in the axis-Y direction. A recess 642, in which the hook 21 of the middle plate 20 can be disposed, is formed between the pair of protrusions 641. The protrusions 641 are portions with which the protruding sections 35 of the outer plate 30 come into contact, as will be described later.

The button unit 70 includes the first button 71, the second button 72, and a lock member 80, as shown in FIGS. 2 to 5 and FIG. 8.

The first button 71 and the second button 72 protrude via the through holes 46 in the first sidewall section 42 and the second sidewall section 43, respectively, and are movably disposed in the axis-Y direction.

The first button 71 includes a base plate 710, a first operation section 711 protruding in the direction Y1 from the base plate 710, and a guide section 712 protruding in the direction Y2 from the base plate 710, as shown in FIG. 8. The first operation section 711 is inserted through the through hole 46 in the first sidewall section 42 and protrudes out of the buckle cover 40. The base plate 710 is disposed in the inner-surface-side opening of the through hole 46 in the first sidewall section 42 and comes into contact with the wall surrounding the elliptical opening to restrict movement of the first button 71 in the direction Y1.

The guide section 712 is formed in the shape of a flat plate and has two side surfaces, a guide surface 712A and a side surface 712B. The guide surface 712A is a side surface facing the direction X2, that is, facing the base 61 of the swing arm 60, and inclines in the direction X1, in which the guide surface 712A separates away from the base 61, that is, approaches the side surface 712B, which is the other side surface, as extending in the direction Y2.

The second button 72 includes a base plate 720, a second operation section 721 protruding in the direction Y2 from the base plate 720, and a guide section 722 protruding in the direction Y1 from the base plate 720, as the first button 71 does. The second operation section 721 is inserted through the through hole 46 in the second sidewall section 43 and protrudes out of the buckle cover 40, and the base plate 720 is disposed in the inner-surface-side opening of the through hole 46 to restrict movement of the second button 72 in the direction Y2.

The guide section 722 is formed in the shape of a flat plate and has a guide surface 722A and a side surface 722B, as also shown in FIG. 4, like the guide section 712. The guide surface 722A inclines in the direction X1, that is, in the direction in which the guide surface 722A approaches the side surface 722B, which is the other side surface, as extending in the direction Y1, as the guide surface 712A does.

The lock member 80 includes an upper surface section 81 provided on the side facing the front surface section 41, a lower surface section 82 provided on the side facing the folding member 2, and a guidance section 83 provided between the upper surface section 81 and the lower surface section 82, as shown in FIG. 8.

A guide groove 811 formed along the axis-X direction is formed at the front surface of the upper surface section 81. The lock member 80 slides in the axis-X direction with the aid of the guide rail section 411 on the rear side of the front surface section 41 and the guide groove 811.

A first side surface 84 of the lock member 80, the side surface facing the direction X2, is a flat surface, and the second contact section 653 of the torsional spring 65 is in contact with the first side surface 84, as also shown in FIG. 10. The torsional spring 65 is so disposed that the first contact sections 651 are in contact with upper end portions of the linkage wall 612 of the swing arm 60, that is, portions shifted in the direction Z1 from the pin 68, which is the axis of rotation, and the second contact section 653 is in contact with the first side surface 84 of the lock member 80. The torsional spring 65 therefore urges the swing arm 60 in the first rotational direction R1 and the lock member 80 in the direction X1.

A second side surface 85 of the lower surface section 82, the side surface facing the direction X1, is an inclining surface that inclines so as to protrude in the direction X1 as extending in the direction Z1. The front surface of the lower surface section 82 is a locking surface 821, which locks the hook 21, as shown in FIGS. 9 and 10.

The guidance section 83 has a pair of guidance surfaces 831, which incline toward each other as extending in the direction X1. The guide surface 712A of the first button 71 and the guide surface 722A of the second button 72 come into contact with the guidance surfaces 831. The guide sections 712 and 722 are disposed between the upper surface section 81 and the lower surface section 82, which restrict movement of the guide sections 712 and 722 in the axis-Z direction.

The lock member 80 is urged in the direction X1 by the torsional spring 65, and the first button 71 and the second button 72 are urged to separate away from each other in the directions Y1 and Y2 when the guidance surfaces 831 come into contact with the guide surfaces 712A and 722A. The base plates 710 and 720 are then maintained being in contact with the first sidewall section 42 and the second sidewall section 43, respectively, that is, the first operation section 711 and the second operation section 721 are maintained protruding out of the buckle cover 40. In this case, the lock member 80 has moved to a locked position where the locking surface 821 can lock the click section 23 of the hook 21.

On the other hand, when a user pushes the first button 71 and the second button 72 in the direction in which the two buttons approach each other, the guide surface 712A of the guide section 712 and the guide surface 722A of the guide section 722 come into contact with the guidance surfaces 831, causing the lock member 80 to move in the direction X2 against the urging force produced by the torsional spring 65 to unlock the hook 21 from the locking surface 821. In this case, the lock member 80 has moved to an unlocked position where the hook 21 is unlocked.

How to Attach and Detach Wristwatch

How the user wears the wristwatch 100 around the user's wrist will next be described.

With the buckle 1 unlocked and the folding member 2 unfolded, as shown in FIG. 3, the user inserts a wrist through the space formed by the first band 11 and the second band 12, and pushes the buckle cover 40 toward the folding member 2 while folding the folding member 2. The hook 21 of the middle plate 20 thus comes into contact with the lock member 80 through one of the openings of the outer plate 30. In this process, the inclining surface 23A of the hook 21 and the inclining second side surface 85 of the lock member come into contact with each other, and the inclining surfaces each cause the lock member 80 to move in the direction X2 so that the click section 23 climbs over the lower surface section 82. The urging force produced by the torsional spring 65 then moves the lock member 80 back in the direction X1, and the click section 23 comes into contact with the locking surface 821 and is locked thereby. The folding member 2 is thus accommodated in the buckle cover 40, and the wristwatch 100 is worn around the user's wrist. In this state, the front surface of the folding member 2 comes into contact with the rear surface of the operation strip 64 of the swing arm 60. Therefore, the rotation of the swing arm 60 in the second rotational direction R2 is restricted, and the engagement click 63 remains in engagement with a groove section 53, so that the band length is also fixed.

How to detach the wristwatch 100 from the wrist will next be described.

When the user presses the first button 71 and the second button 72, the guide surfaces 712A and 722A push the guidance surfaces 831, causing the lock member 80 to move in the direction X2 to unlock the lock member 80 from the locking surface 821.

Figure 11:
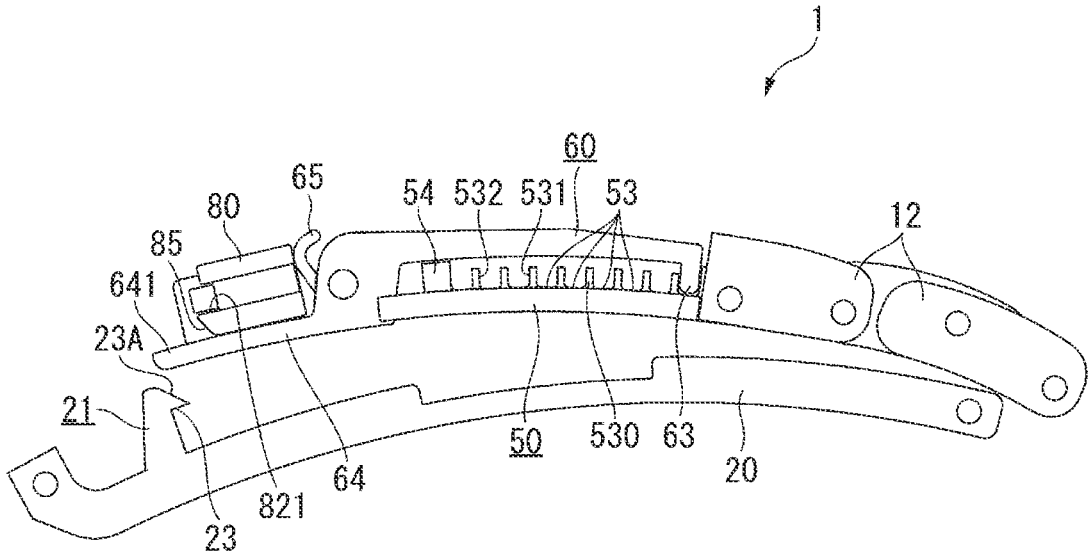
FIG. 11 is a side view showing the key parts of the unlocked buckle in the embodiment.

The middle plate 20 and outer plate 30 of the folding member 2 having been folded and accommodated in the buckle cover 40 can therefore be unfolded, as shown in FIG. 11, so that the wristwatch 100 can be detached from the wrist.

How to Adjust Band Length

How to adjust the band length will next be described with reference to FIGS. 12 to 14. In the process of rotating the outer plate 30 relative to the buckle cover 40 in the following description, the direction in which the outer plate 30 moves away from the buckle cover 40 is called a third rotational direction R3, and the direction in which the outer plate 30 approaches the buckle cover 40 is called a fourth rotational direction R4.

In the state in which the middle plate 20 and the outer plate 30 of the folding member 2 are unfolded, the folding member 2 is not in contact with the operation strip 64 of the swing arm 60, so that the swing arm 60 is also allowed to rotate in the second rotational direction R2. In this state, the outer plate 30 rotates in the third rotational direction R3, and the protruding sections 35 formed at the shafts 32 are brought into contact with the surfaces of the protrusions 641 to push the protrusions 641. The operating strip 64 of the swing arm 60 thus moves in the direction Z2, that is, downward, so that the arm section 62 and engagement click 63 move in the direction Z1, that is, upward. The swing arm 60 therefore rotates in the second rotational direction R2 against the urging force produced by the torsional spring 65. The front end of the engagement click 63 climbs over the upper end of a groove wall section 530 of the slide plate 50 and disengages from the groove section 53. The user can therefore move the slide plate 50 and the second band 12 in both the directions X1 and X2.

Figure 12:
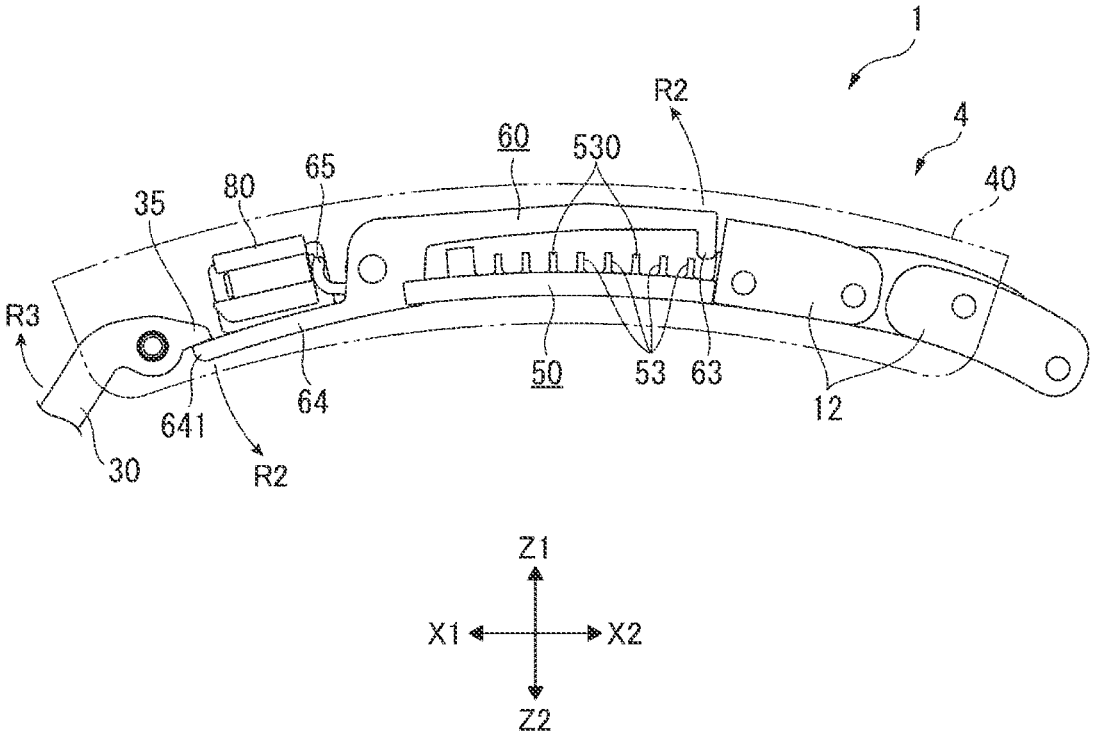
FIG. 12 is a side view showing a band length adjustment state in the embodiment.
Figure 13:
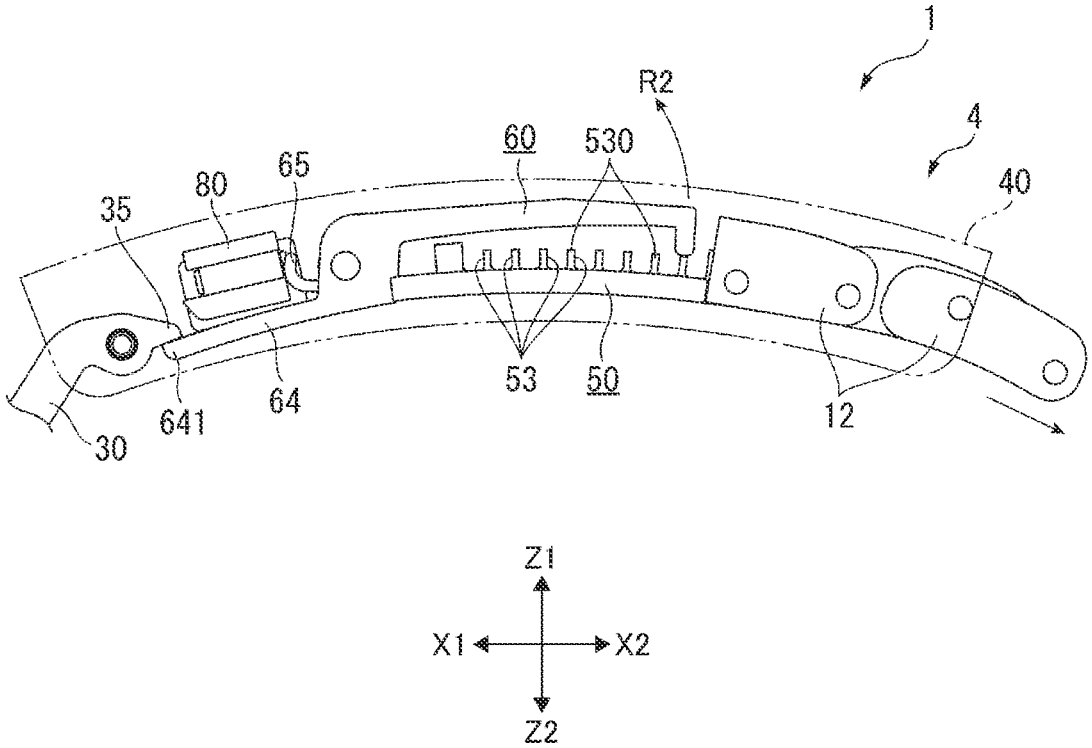
FIG. 13 is a side view showing another band length adjustment state in the embodiment.
Figure 14:
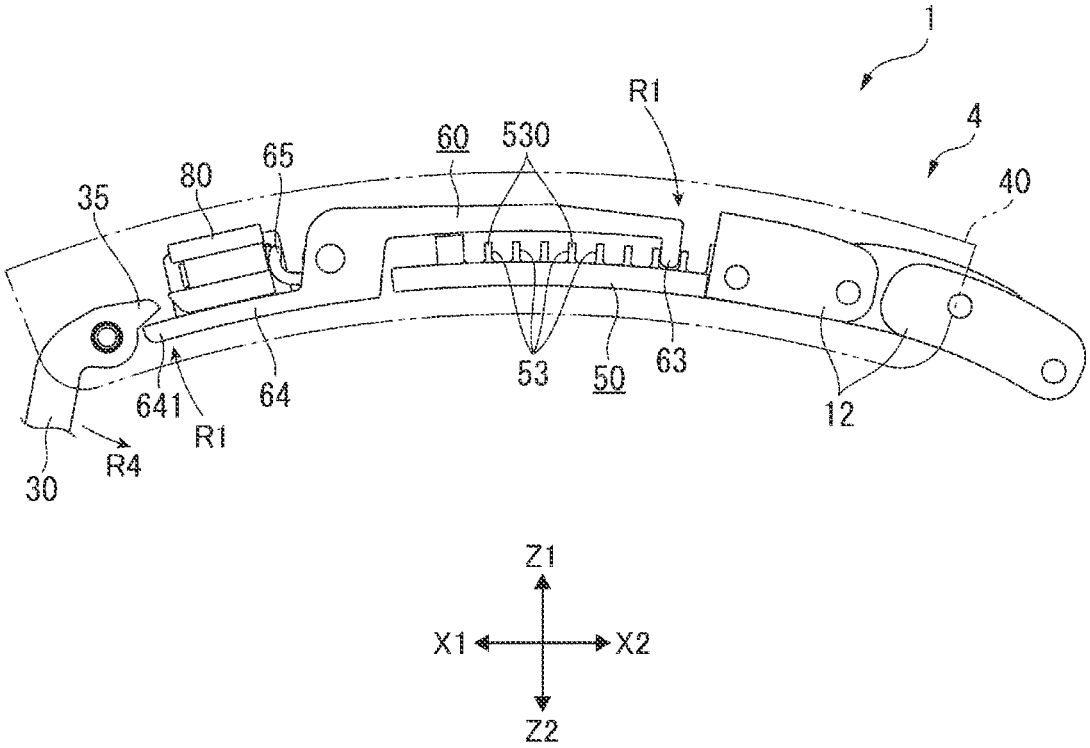
FIG. 14 is a side view showing another band length adjustment state in the embodiment.

For example, the second band 12 and the slide plate 50 are moved in the direction in which the second band 12 and the slide plate 50 are pulled out of the buckle cover 40 with the outer plate 30 rotated in the third rotational direction R3 and the swing arm 60 rotated in the second rotational direction R2, as shown in FIGS. 12 and 13. After the band length is adjusted to a desired length, and when the outer plate 30 is rotated in the fourth rotational direction R4 to move the protruding sections 35 away from the protrusions 641, the urging force produced by the torsional spring 65 rotates the swing arm 60 in the first rotational direction R1, and the engagement click 63 engages with a groove section 53, as shown in FIG. 14. The operation described above allows the position of the slide plate 50 to be adjusted by the number of groove sections 53 at the maximum. The slide plate 50 includes nine groove sections 53, which allow the position of the slide plate 50 to be adjusted to any of the nine positions. Thereafter, when the hook 21 is locked by the lock member 80 and the folding member 2 is accommodated in the buckle cover 40, the folding member 2 comes into contact with the operation strip 64 to restrict the rotation of the swing arm 60 in the second rotational direction R2, as described above. The movement of the slide plate 50, that is, the adjustment of the band length, can therefore also be restricted.

Figure 15:
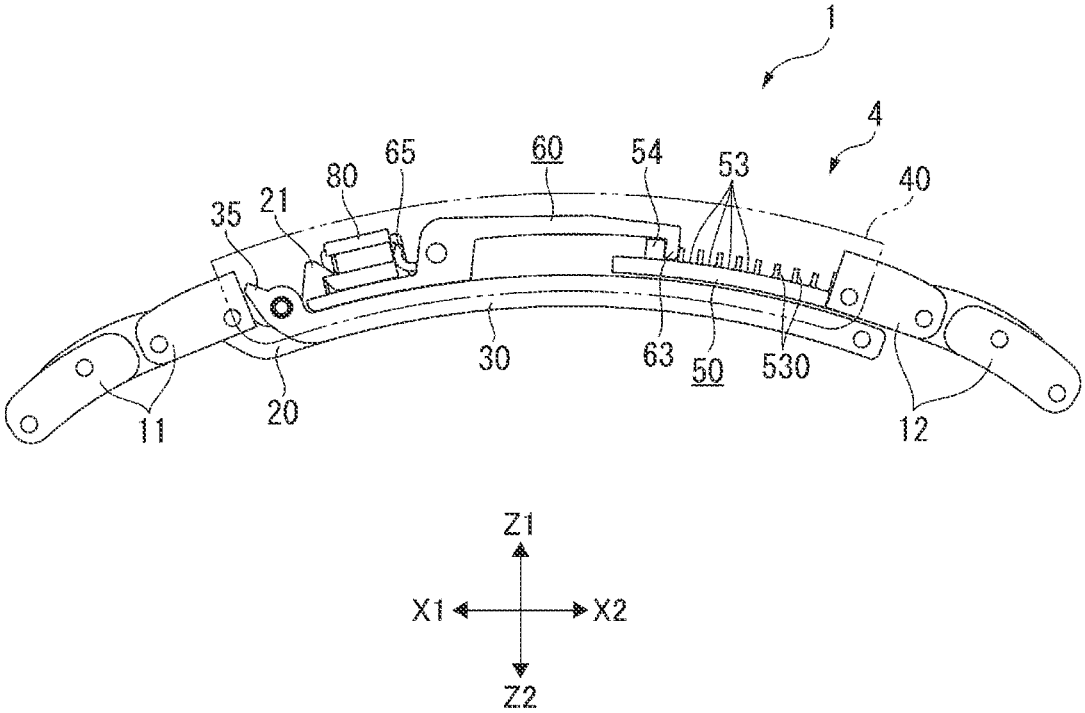
FIG. 15 is a side view showing a maximum band length state in the embodiment.

The height of the restriction surface 54A is greater than that of the groove wall sections 530, so that even when the engagement click 63 has moved to a height where the engagement click 63 does not come into contact with the groove wall sections 530, the engagement click 63 comes into contact with the restriction surface 54A. Therefore, the movement of the slide plate 50 in the direction X2 is restricted by the second facing surface 632 of the engagement click 63 having come into contact with the restriction surface 54A, the restriction of the movement prevents the slide plate 50 from coming off the buckle cover 40. Therefore, to increase the band length by moving the slide plate 50 in the direction X2, the state shown in FIG. 15, in which the engagement click 63 is in contact with the movement restriction section 54, is a maximum band length state in which the band length is maximized, and the any further movement of the slide plate 50 in the direction X2 is restricted. The second facing surface 632 of the engagement click 63 is therefore a contact surface that comes into contact with the restriction surface 54A.

To attach the slide plate 50 and the swing arm 60 to the buckle cover 40, the slide plate 50 may be placed in the guide grooves 44 of the buckle cover 40, and the slide plate 50 may be caused to slide in the direction X1 with the swing arm 60 assembled with the slide plate 50, and the pin 68 may be inserted through the through holes 49 and the base 61 so that the swing arm 60 is supported. Conversely, to detach the slide plate 50 and the swing arm 60 from the buckle cover 40 for maintenance or other purposes, the pin 68 may be removed, and the swing arm 60 and the slide plate 50 may be caused to slide in the direction X2 to detach the swing arm 60 and the slide plate 50 from the buckle cover 40.

Effects of Embodiment

The buckle 1 according to the present embodiment allows the user to detach the folding member 2 from the buckle cover 40 and rotate the outer plate 30 in the third rotational direction R3 to cause the protruding sections 35 of the outer plate 30 to come into contact with the operation strip 64 of the swing arm 60, whereby the swing arm 60 can be rotated in the second rotational direction R2 to detach the engagement click 63 of the swing arm 60 from a groove section 53 of the slide plate 50, so that the engagement click 63 disengages from the groove section 53. The band length can therefore be changed by pushing the second band 12 toward the buckle cover 40 or pulling the second band 12 from the buckle cover 40 to cause the slide plate 50 to slide. The band length can thus be readily adjusted with no button operation.

Furthermore, since the buckle 1 is formed of a small number of parts, the buckle 1 can be readily assembled, and the cost of the buckle 1 can be reduced. Moreover, the band length can be adjusted in multiple steps in accordance with the number of groove sections 53 by the distance between the groove sections 53 in each step, allowing the band length to readily fit the user's wrist or any other body site.

The groove sections 53 of the slide plate 50 are segmented and formed by the groove wall sections 530 each having the first perpendicular surface 531 and the second perpendicular surface 532, which are perpendicular to the sliding direction of the slide plate 50. On the other hand, the engagement click 63 has the first facing surface 631, which faces, when the engagement click 63 engages with a groove section 53, the first perpendicular surface 531, and the second facing surface 632, which faces the second perpendicular surface 532. The first facing surface 631 and the second facing surface 632, which face the first perpendicular surface 531 and the second perpendicular surface 532, respectively, are surfaces perpendicular to the sliding direction. Therefore, when a force in the sliding direction acts on the slide plate 50 with the engagement click 63 engaging with the groove section 53, the first perpendicular surface 531 comes into contact with the first facing surface 631, or the second perpendicular surface 532 comes into contact with the second facing surface 632. The movement of the slide plate 50 in the sliding direction can therefore be restricted. The slide plate 50 therefore does not move unless the swing arm 60 is rotated in the second rotational direction R2 by using the outer plate 30 of the folding member 2. That is, unintentional movement of the slide plate 50 and change in the band length can be avoided.

In the state in which the folding member 2 is folded and accommodated in the buckle cover 40, when the front surface of the folding member 2, that is, the front surfaces of the middle plate 20 and the outer plate 30 come into contact with the rear surface of the operation strip 64, rotation of the swing arm 60 in the second rotational direction R2 can be restricted, whereby the engagement of the engagement click 63 with the groove section 53 can be maintained. Therefore, with the band worn around the user's wrist or any other body site, the state in which the slide plate 50 is not allowed to slide, that is, the band length cannot be adjusted can be reliably maintained. An unintentional change in the length of the band worn on the user can therefore be reliably avoided.

Furthermore, when the folding member 2 comes into contact with the operation strip 64 of the swing arm 60, rotation of the swing arm 60 in the second rotational direction R2 can be restricted, whereby the simple structure can reliably restrict the rotation of the swing arm 60.

Furthermore, since the operation strip 64 can have a relatively large area, the contact area where the operation strip 64 comes into contact with the accommodated folding member 2 can also be a large area. The rotation of the swing arm 60 can therefore be reliably restricted by reliably causing the operation strip 64 to come into contact with the folding member 2.

The operation strip 64 is disposed on the side facing the torsional spring 65 and the rear surface of the lock member 80 and can hide the torsional spring 65 and the lock member 80, whereby the appearance of the buckle 1 can be simplified when the user looks at the rear side thereof, and the aesthetic appeal thereof can be improved. Furthermore, when the user looks at the rear side of the buckle 1, the engagement click 63 of the swing arm 60 is hidden behind the slide plate 50, and the groove sections 53 of the slide plate 50 are also not exposed to the rear side of the buckle 1. Also in this regard, the appearance of the rear side of the buckle 1 can be simplified, and the aesthetic appeal thereof can be improved.

The buckle 1 includes the torsional spring 65, which urges the swing arm 60 in the first rotational direction R1. Rotating the outer plate 30 in the fourth rotational direction R4 therefore causes the protruding sections 35 of the outer plate 30 that is in contact with the protrusions 641 of the operation strip 64 to be separate from the protrusions 641 of the operation strip 64. The urging force produced by the torsional spring 65 then rotates the swing arm 60 in the first rotational direction R1, allowing the engagement click 63 to engage with a groove section 53. The engagement click 63 is thus allowed to immediately engage with the groove section 53. Therefore, there is no need to manually rotate the swing arm 60 in the first rotational direction R1 by rotating the folding member 2, and unintentional movement of the slide plate 50 during the rotation and the resultant change in the adjusted band length can be avoided.

Since the folding member 2 is provided with the hook 21, and the lock member 80, which is moved to the locked position where the hook 21 is locked and to the unlocked position where the hook 21 is unlocked, is provided, moving the lock member 80 reliably achieves the state in which the folding member 2 is folded and accommodated in the buckle cover 40 so that the folding member 2 is locked, and the state in which the folding member 2 is detached from the buckle cover 40 so that the folding member 2 is unlocked. Since the lock member 80 moves to lock or unlock the hook 21, durability of the buckle cover can be improved as compared, for example, with a case where the locked and unlocked states are achieved by deforming the sidewall sections or any other portion of the buckle cover.

The single torsional spring 65 serves as both the spring that urges the swing arm 60 in the first rotational direction R1 and the spring that urges the lock member 80 to the locked position. Furthermore, the first button 71 and the second button 72 are urged in opposite directions when the lock member 80 is moved to the locked position. Therefore, the number of parts can be reduced, and the assembly can be readily performed, so that the cost can be reduced as compared with a case where separate springs urge the swing arm 60 and the lock member 80.

Since the guide grooves 44 are formed in the buckle cover 40, and the plate section 51 of the slide plate 50 is inserted into the guide grooves 44, the slide plate 50 moves stably without rattling. The band length can thus be adjusted in a stable, smooth manner. The guide grooves 44 are formed in the direction X1 only to a position halfway along the first sidewall section 42 and the second sidewall section 43, whereby the movement of the slide plate 50 in the direction X1 can be restricted. The movement restriction prevents the slide plate 50 from colliding with and damaging the swing arm 60 and other components.

The slide plate 50 is provided with the movement restriction section 54, which can restrict the movement of the slide plate 50 in the direction X2. The movement restriction prevents the engagement click 63 of the swing arm 60 from coming off the slide plate 50 or the slide plate 50 from coming off the buckle cover 40 when the slide plate 50 is pulled out and the band length is adjusted.

Variations

The present disclosure is not limited to the embodiment described above, and variations, improvements, and other modifications to the extent that the advantage of the present disclosure is achieved fall within the scope of the present disclosure.

For example, the groove sections 53 of the slide plate 50 are not necessarily formed by the groove wall sections 530, which stand upright from the plate section 51 in the direction perpendicular to the sliding direction. For example, the engagement click 63 may have a triangular cross-sectional shape, and the groove sections 53 may each have an inverted triangular cross-sectional shape in accordance with the shape of the engagement click 63. The groove sections 53 and the engagement click 63 do not need to necessarily have the same cross-sectional shape. The cross-sectional shapes of the groove sections 53 and the engagement click 63 only need to allow the engagement click 63 to engage with the groove section 53 to restrict the movement of the slide plate 50 when the swing arm 60 is rotated in the first rotational direction R1. Furthermore, the cross-sectional shapes of the groove sections 53 and the engagement click 63 only need to allow the engagement click 63 to disengage from the groove section 53 to cancel the restriction of the movement of the slide plate 50 when the swing arm 60 is rotated in the second rotational direction R2 by rotating the protruding sections 35 of the outer plate 30 with the protruding sections 35 pressed against the operation strip 64.

The configuration that restricts the rotation of the swing arm 60 in the second rotational direction R2 is not limited to the configuration in which the front surface of the folding member 2 is caused to come into contact with the rear surface of the operation strip 64.

For example, the rotation of the swing arm 60 may be restricted by providing the folding member 2 with a protruding element that comes into contact with the linkage wall 612 when the folding member 2 is accommodated in the buckle cover 40 to restrict the rotation of the swing arm 60 in the second rotational direction R2.

The configuration that locks the folding member 2 is not limited to the configuration using the hook 21 including the click section 23 and the sliding lock member 80. For example, the folding member 2 may be provided with a lock pin having a shaft section and an umbrella section located at the front end of the shaft section and having a diameter greater than that of the shaft section, and a button unit provided in the buckle cover 40 may be used to lock or unlock the lock pin. That is, the folding member 2 only needs to be locked with the folding member 2 accommodated in the buckle cover 40.

In the embodiment described above, the torsional spring 65 produces the urging force for rotating the swing arm 60 and the urging force for moving the lock member 80 to the locked position, and the urging forces may instead be produced by separate springs. Furthermore, a spring that moves the lock member 80 to the locked position and a spring that urges the first button 71 and second button 72 in opposite directions may be provided separately.

Moreover, the spring that urges the swing arm 60 in the first rotational direction R1 may not necessarily be provided. That is, the reason for this is that the swing arm 60 can be rotated in the first rotational direction R1 to cause the engagement click 63 to engage with the groove section 53 by causing the folding member 2 to come into contact with the operation strip 64 when the folding member 2 is folded and accommodated in the buckle cover 40.

The slide plate 50 is not necessarily guided along the guide grooves 44 of the buckle cover 40. For example, concave grooves may be formed at the side surfaces of the slide plate 50, and convex guide rail portions inserted into the concave grooves of the slide plate 50 may be formed at the inner surfaces of the first sidewall section 42 and the second sidewall section 43. The slide plate 50 does not necessarily have a front end at which the movement restriction section 54 is provided.

The buckle 1 can be used not only as part of a timepiece band, but also, for example, as part of a bracelet, a necklace, and other accessory bands.

Overview of Present Disclosure

A buckle according to an aspect of the present disclosure is a buckle that links a first band and a second band to each other, the buckle including a folding member linked to the first band, a buckle cover pivotably linked to the folding member, a slide plate supported slidably relative to the buckle cover in the longitudinal direction of the first band and the second band and linked to the second band, and a swing arm rotatably supported by the buckle cover. The slide plate has a plurality of groove sections provided along the longitudinal direction. The swing arm includes a base rotatably supported by the buckle cover, an arm section extending from the base toward the slide plate, an engagement click provided at the arm section and engageable with any of the groove sections of the slide plate, and an operation strip extending from the base toward the side opposite to the arm section. The swing arm is supported rotatably in a first rotational direction in which the engagement click engages with any of the groove sections and in a second rotational direction in which the engagement click separates from the groove section. The folding member includes a protruding section that comes into contact with the operation strip to rotate the swing arm in the second rotational direction when the folding member is rotated relative to the buckle cover.

The buckle according to the aspect of the present disclosure allows the folding member to be detached from the buckle cover and rotated to cause the protruding section of the folding member to come into contact with the operating strip of the swing arm. The swing arm can then be rotated in the second rotational direction to separate the engagement click of the swing arm from the groove section of the slide plate. The band length can therefore be changed by causing the slide plate to slide, whereby the band length can be readily adjusted without any button operation.

Furthermore, since the buckle is formed of a small number of parts, the buckle can be readily assembled, and the cost thereof can be reduced. Moreover, the band length can be adjusted in multiple steps in accordance with the number of groove sections by the distance between the groove sections in each step, whereby the band length can be readily fit the user's wrist or any other body site.

In the buckle according to the aspect of the present disclosure, it is preferable that the groove sections are each segmented by a first perpendicular surface and a second perpendicular surface perpendicular to the sliding direction of the slide plate, and that the engagement click has a first facing surface facing the first perpendicular surface and a second facing surface facing the second perpendicular surface with the engagement click engaged with the groove section.

In the buckle according to the aspect of the present disclosure, the groove sections each have the first perpendicular surface and the second perpendicular surface perpendicular to the sliding direction of the slide plate, and the engagement click has the first facing surface and the second facing surface. The first facing surface and the second facing surface, which face the respective perpendicular surfaces, are surfaces perpendicular to the sliding direction. Therefore, when a force in the sliding direction acts on the slide plate with the engagement click engaging with any of the groove sections, the first perpendicular surface comes into contact with the first facing surface, or the second perpendicular surface comes into contact with the second facing surface, so that movement of the slide plate in the sliding direction is restricted. The slide plate therefore does not move unless the swing arm is rotated in the second rotational direction by the folding member. Unintentional movement of the slide plate that changes the band length can therefore be avoided.

In the buckle according to the aspect of the present disclosure, it is preferable that the folding member restricts rotation of the swing arm in the second rotational direction with the folding member accommodated in the buckle cover.

The buckle according to the aspect of the present disclosure can restrict rotation of the swing arm in the second rotational direction with the folding member folded and accommodated in the buckle cover, for example, by causing the folding member to come into contact with the operating strip of the swing arm, whereby the engagement between the engagement click and the groove section can be maintained. Therefore, in the state in which the band is worn around the user's wrist or any other body site, the slide plate is not allowed to slide. That is, the state in which adjustment of the band length is not allowed can be reliably maintained, whereby a situation in which the band length changes when the band is worn can be reliably avoided.

Furthermore, for example, when the folding member comes into contact with the swing arm, rotation of the swing arm in the second rotational direction can be restricted, whereby the simple structure can reliably restrict the rotation of the swing arm.

It is preferable that the buckle according to the aspect of the present disclosure includes a spring that urges the swing arm in the first rotational direction.

The buckle according to the aspect of the present disclosure includes a spring that urges the swing arm in the first rotational direction. Therefore, when the folding member is rotated to cause the protruding section of the folding member in contact with the operating strip of the swing arm to separate from the operating strip, the urging force produced by the spring rotates the swing arm in the first rotational direction, and the engagement click can engage with the groove section. The engagement click can thus immediately engage with the groove section. There is then no need to manually rotate the swing arm in the first rotational direction by rotating the folding member, whereby a situation in which movement of the slide plate during the rotation undesirably changes the adjusted band length can be avoided.

It is preferable that the buckle according to the aspect of the present disclosure includes a button unit including a lock member urged by the spring and a first button and a second button protruding out of the buckle cover, that the folding member is provided with a hook, that when the lock member is urged by the spring, the lock member urges the first button and the second button in opposite directions and moves to a locked position where the hook is locked, and when the first button and the second button are pushed, the lock member is moved against the urging force produced by the spring to an unlocked position where the hook is unlocked.

In the buckle according to the aspect of the present disclosure, in which the folding member is provided with the hook, and the lock member, which is moved to the locked position where the hook is locked and to the unlocked position where the hook is unlocked is provided, whereby the locked state in which the folding member is accommodated in the buckle cover and the unlocked state can be reliably achieved. Since the lock member moves to lock or unlock the hook, durability of the buckle cover can be improved as compared, for example, with the case where the locked and unlocked states are achieved by deforming the sidewall sections or any other portion of the buckle cover.

The single spring serves as both the spring that urges the swing arm in the first rotational direction and the spring that urges the lock member to the locked position. Furthermore, the first button and the second button are urged in opposite directions when the lock member is moved to the locked position. Therefore, the number of parts can be reduced, and the assembly can be readily performed, so that the cost can be reduced as compared with the case where separate springs urge the swing arm and the lock member.

In the buckle according to the aspect of the present disclosure, it is preferable that the buckle cover includes a front surface section, a first sidewall section, and a second sidewall section, that guide grooves extending along the longitudinal direction are formed at the inner surfaces of the first sidewall section and the second sidewall section, and that the slide plate includes a plate section inserted into the guide grooves.

The buckle according to the aspect of the present disclosure, in which the plate section of the slide plate is inserted into the guide grooves so that the slide plate moves stably, allows stable, smooth adjustment of the band length. Furthermore, since the range over which the slide plate moves can be set by the guide grooves, damage to other parts due to collision of the slide plate with the other parts can also be suppressed.

In the buckle according to the aspect of the present disclosure, it is preferable that the slide plate includes a movement restriction section provided continuously with the groove sections, that the movement restriction section has a restriction surface perpendicular to the sliding direction of the slide plate and protruding beyond the groove sections, and that the engagement click has a contact surface that comes into contact with the restriction surface.

In the buckle according to the aspect of the present disclosure, one of the facing surfaces of the engagement click of the swing arm comes into contact with the restriction surface, whereby the movement of the slide plate can be restricted. The movement restriction prevents the engagement click of the swing arm from coming off the slide plate when the slide plate is moved to adjust the band length.

A timepiece according to another aspect of the present disclosure includes the buckle described above.

The timepiece according to the other aspect of the present disclosure, which includes the buckle described above, can provide the effects described above, readily allows the band length adjustment, and is applicable to a variety of timepieces.

What is claimed is:

1. A buckle that links a first band and a second band to each other, the buckle comprising:

a folding member linked to the first band;

a buckle cover pivotably linked to the folding member;

a slide plate supported slidably relative to the buckle cover in a longitudinal direction of the first band and the second band and linked to the second band; and a swing arm rotatably supported by the buckle cover, wherein the slide plate has a plurality of groove sections provided along the longitudinal direction, the swing arm includes a base rotatably supported by the buckle cover, an arm section extending from the base toward the slide plate, an engagement click provided at the arm section and engageable with any of the groove sections of the slide plate, and an operation strip extending from the base toward a side opposite to the arm section, the swing arm supported rotatably in a first rotational direction in which the engagement click engages with any of the groove sections and in a second rotational direction in which the engagement click separates from the groove section, and the folding member includes a protruding section that comes into contact with the operation strip to rotate the swing arm in the second rotational direction when the folding member is rotated relative to the buckle cover.

2. The buckle according to claim 1, wherein the groove sections are each segmented by a first perpendicular surface and a second perpendicular surface perpendicular to a sliding direction of the slide plate, and the engagement click has a first facing surface facing the first perpendicular surface and a second facing surface facing the second perpendicular surface with the engagement click engaged with any of the groove sections.

3. The buckle according to claim 1, wherein the folding member restricts rotation of the swing arm in the second rotational direction with the folding member accommodated in the buckle cover.

4. The buckle according to claim 1, further comprising a spring that urges the swing arm in the first rotational direction.

5. The buckle according to claim 4, further comprising a button unit including a lock member urged by the spring and a first button and a second button protruding out of the buckle cover, wherein the folding member is provided with a hook, and when the lock member is urged by the spring, the lock member urges the first button and the second button in opposite directions and moves to a locked position where the hook is locked, and when the first button and the second button are pushed, the lock member is moved against an urging force produced by the spring to an unlocked position where the hook is unlocked.

6. The buckle according to claim 1, wherein the buckle cover includes a front surface section, a first sidewall section, and a second sidewall section, guide grooves extending along the longitudinal direction are formed at inner surfaces of the first sidewall section and the second sidewall section, and the slide plate includes a plate section inserted into the guide grooves.

7. The buckle according to claim 1, wherein the slide plate includes a movement restriction section provided continuously with the groove sections, the movement restriction section has a restriction surface perpendicular to the sliding direction of the slide plate and protruding beyond the groove sections, and the engagement click has a contact surface that comes into contact with the restriction surface.

8. A timepiece comprising the buckle according to claim 1.

* * * * *